United States Patent [19]

Noblitt

[11] 3,985,645

[45] Oct. 12, 1976

[54] SCHEELITE FLOTATION

[75] Inventor: Harvey Leander Noblitt, Ottawa, Canada

[73] Assignee: Canadian Patents and Development Limited, Ottawa, Canada

[22] Filed: Oct. 11, 1974

[21] Appl. No.: 514,049

[30] Foreign Application Priority Data

Oct. 11, 1973 Canada ..... 183171

[52] U.S. Cl. ..... 209/10; 209/11; 209/166

[51] Int. Cl.[2] ..... B03B 7/00

[58] Field of Search ..... 209/9, 166, 167, 10, 209/3, 11

[56] References Cited

UNITED STATES PATENTS

| | | | |
|---|---|---|---|
| 2,471,414 | 5/1949 | Dasher | 209/9 |
| 2,951,585 | 9/1960 | Burks | 209/167 |
| 3,014,585 | 12/1961 | Noblitt | 209/166 X |
| 3,246,748 | 4/1966 | Burwell | 209/166 X |
| 3,259,242 | 7/1966 | Snow | 209/166 |
| 3,300,147 | 1/1967 | Johnston | 209/166 X |
| 3,441,401 | 4/1969 | Stone | 209/166 X |
| 3,830,366 | 8/1974 | Day | 209/166 |

OTHER PUBLICATIONS

Chem. Abst., 66, 1967, 21216c.

Chem. Abst., 67, 1968, 89180h.

*Primary Examiner*—Robert Halper

*Attorney, Agent, or Firm*—Sughrue, Rothwell, Mion, Zinn and Macpeak

[57] ABSTRACT

A process for the separation of scheelite from calcite present in an ore or a concentrate formed from an ore, which process includes the steps of decomposing any flotation agent residues contained in the concentrate, and treating the ore or concentrate to condition the particle surfaces with a mono-substituted butane diamine of the formula $H_2N.C_4H_8.N(H)R$, wherein R is a long-chain saturated or partially-unsaturated aliphatic hydrocarbon radical having at least 14 carbon atoms. The treated ore or concentrate is subjected to flotation in an aqueous system, and the scheelite is recovered in the flotation froth.

14 Claims, No Drawings

SCHEELITE FLOTATION

This invention relates to the separation of scheelite (calcium tungstenate) from calcite (calcium carbonate) present in a concentrate formed by flotation thereof from an ore.

Commercial methods of floating scheelite and calcite from the ore in which they occur employ fatty acids, such as oleic acid, which rejects quartz, silicates, sulphides and oxides. Scheelite and calcite are found together in the resultant froth and constitute the bulk of the concentrate. In order to obtain a high grade scheelite concentrate, it is necessary to remove the calcite from the concentrate and this phase of the ore-treatment process has received considerable attention from researchers in this field.

It will be appreciated that most tungsten-producing mines are located in remote areas of the world. Therefore, the economic considerations involved in the processing of the ores obtained from these mines are of paramount importance, since the transportation of processing materials and the ores themselves to and from these remote areas — as well as the labour costs when extra manpower is required for extensive processing operations — is extremely expensive.

A Canadian mine, producing scheelite, is the mine of Canada Tungsten Mining Corporation in the North West Territories. At this mine, the primary ore is fed to a jaw crusher and stockpiled prior to feeding to a concentrator, wherefrom a concentrate containing scheelite and calcite is obtained. The concentrate is dried and shipped to Vancouver and there the calcite is dissolved in dilute hydrochloric acid and the scheelite thereby recovered. The flotation concentrate typically contains about 76% calcite and from 22 to 24% scheelite. Therefore, for every ton of scheelite recovered, freight charges must be paid on approximately 3 tons of calcite. Furthermore, the reaction product of the hydrochloric acid with the calcite is essentially calcium chloride, which in most cases is treated as a corrosive waste-product. It has been proposed to perform the acid-treatment process at the mine site, but clearly, the calcium chloride disposal or pollution problem would simply be transferred to that area. Also, hydrochloric acid is a relatively expensive reagent for the separation of calcite from scheelite, particularly in terms of the extra facilities which are required in connection with its use. This is of great significance in an area such as the Canadian North, where the provision of extra equipment and men and the associated housing, etc., is particularly expensive. As stated above, this problem is by no means confined to the foregoing example, since most mines of this type are to be found in the more remote areas of the world where the economic factors involved in ore-processing are of paramount importance.

In attempts to find more economical and efficient alternatives to hydrochloric acid treatment, various other reagents have been employed for selective flotation of scheelite and depression of calcite — for example, sulphoxides, FAB detergent, quebracho, fatty-acid sulphonates, and others, but with only moderate success.

U.S. Pat. No. 3,246,748 (Burwell) issued Apr. 19, 1966, teaches a process whereby the ore or concentrate thereof is roasted to form a non-reacting film on the surface of the calcite which prevents its subsequent flotation — other mineral surfaces, such as scheelite being unaffected. Using the Burwell method, the collection and flotation reagent requires no selectivity between scheelite and calcite, since the calcite will not be floated due to the non-reacting film which has been formed at the surface thereof. Therefore, the only criticality of the flotation reagent is that it should float scheelite. However, the temperatures required for practical implementation of the Burwell process are relatively high — the roasting temperatures must be between about 500° and about 900° F. and the pulp temperature prior to conditioning and flotation must be between about 170° and 195° F. Also, in practice, the use of quebracho appears highly desirable to depress the calcite, notwithstanding the heat treatment performed upon the calcite to inhibit its flotability.

The present invention has for its object the provision of a process for separating scheelite from calcite which does not require the use of hydrochloric acid and which obviates the requirement for special heating of the flotation solution beyond the 50° to 60° F. temperatures normally required for amine flotation. It is a further object of the invention to provide a process which does not depend upon the use of a depressant — such as quebracho—for the calcite, and which therefore avoids release of such depressant in the tailing solution, since quebracho, particularly, has the effect of inhibiting or completely preventing amine flotation (which may be required for recovery of other values from the tailings).

Thus, according to the present invention there is provided a process for the separation of scheelite from calcite present in an ore or a concentrate formed from an ore, comprising the steps of decomposing any flotation agent residues contained in said concentrate, treating said ore or concentrate, to condition the particle surfaces, with a mono-substituted butane diamine of the formula: $H_2N.C_4H_8.N(H)R$; wherein R is a long-chain saturated or partially unsaturated aliphatic hydrocarbon radical, and subjecting the conditioned ore or concentrate to flotation in an aqueous system, and recovering the scheelite.

According to one embodiment of the invention, any flotation agent residues contained in the concentrate are decomposed by heating.

According to a further embodiment of the invention, the concentrate is formed by fatty acid flotation from an ore and any fatty acid residues contained in said concentrate are decomposed by heating.

The radical R preferably contains 14 to 18 carbon atoms and, more preferably, the radical R is aliphatic $C_{18}$ or a naturally-occurring mixture of aliphatic $C_{16}$ and $C_{18}$, whereupon the octadecyl butane diamine for instance has the formula: $H_2N.(CH_2)_4.NH.C_{18}H_{37}$.

It is also preferred that the monosubstituted butane diamine reagent be added in an amount of between about 0.1 and about 2.0 pounds per ton of ore or concentrate.

The invention will now be described further by way of example only, and with reference to a series of comparative tests conducted upon scheelite-calcite concentrate. These tests are described below and the results are tabulated in Table 1.

In each test, the concentrate was obtained by use of the following procedure from ores mined by the Canada Tungsten Company.

The primary ore was crushed and screened to one-half inch and this material was ground in a rod-mill and all discharge therefrom made to pass through a 65 mesh screen. All screen under size was conditioned with 1 pound of lime per ton of ore and was then floated in Denver flotation cells ("Denver" is a trademark) with xanthate and MIBC (methyl isobutyl carbinol) frother, each added at the rate of 0.025 pounds per ton of ore for removal of sulphides.

The sulphide tailing was distributed to eighteen Concenco "666" (trademark of Deister Concentrator Company, Fort Wayne, Indiana, U.S.A.) triple-decked shaking tables and the concentrate cleaned on six similar tables to produce a combined concentrate containing 62% $WO_3$ and 5% sulphur. The combined concentrate was dewatered before being roasted and subjected to magnetic separation. Cleaner table tailing and rougher middling were conditioned with soda ash, caustic soda, sodium cyanide, sodium silicate and quebracho before being floated by a fatty acid and a nonionic frother. The fatty acid employed was a fatty acid tall oil available from Hercules Canada Ltd. under the trademark "Pamak" in an amount of about 0.16 pounds per ton of solids and the frother was Emcol 4150 (trademark of Emulsol Corporation) in an amount of about 0.01 pounds per ton.

The resulting second flotation concentrate was filtered, dried and heated to 500° C. for an hour and then cooled. This heat-treated concentrate was used in the following tests:

Test No. 1

The scheelite-calcite concentrate was subjected to rougher flotation using 0.08 pounds/ton of an alcoholic-type frother available from Cyanamid of Canada under the trademark "Aerofroth 71" and 0.5 pounds/ton Igepon T-33 in distilled water. "Igepon T-33" is a trademark for N-methyl-N-oleoyl taurate (used inter alia for the flotation of barite and celestite, and its use in selectively floating these concentrates forms the subject of Canadian Pat. No. 914,809, issued Nov. 14, 1972, to the assignees of the present application). The concentrate was cleaned and recleaned and the final results clearly show that there is no selectivity for scheelite over calcite when Igepon T-33 is used.

Test No. 2

The scheelite-calcite concentrate was subjected to rougher flotation using 0.08 pounds/ton of Aerofroth 71 and 0.5 pounds/ton of Armac-S in distilled water. Armac-S is a trademark for the acetate salt of soy oil monoamine. The concentrate was cleaned and recleaned in water and the results show that whilst a reasonable grade of scheelite is obtained, the recovery indicates only moderate selectivity of the Armac-S for scheelite flotation.

Test No. 3

The scheelite-calcite concentrate was subjected to rougher flotation using 0.42 pounds/ton of octadecyl butane diamine in distilled water, using Aerofroth 71 frother in an amount of 0.08 pounds/ton. The concentrate was then cleaned with 0.008 pounds/ton of the octadecyl butane diamine and recleaned with no additions. As can be seen from the results in Table 1, the recovery was well over 80% and it was estimated that on a continuous basis, the recovery should be over 90% with an average grade of approximately 50% scheelite.

Test No. 4

The mono-substituted butane diamine of Test No. 3 was solubilized with HCl and the scheelite-calcite concentrate subjected to rougher flotation with this reagent in an amount of 1.6 pounds/ton, using Aerofroth 71 as the frother in an amount of 0.08 pounds/ton. The concentrate was cleaned using 0.15 pounds/ton of the mono-substituted butane diamine reagent and recleaned with no added reagent but with the addition of 0.04 pounds/ton pine oil.

The results showed that the use of the much larger amounts of reagent in this test gave increased recovery of the scheelite but the grade was impaired to the increased flotation of calcite. It was also noted that separation after the first cleaning stage was prevented by flocculation.

Test No. 5

The scheelite-calcite concentrate was conditioned for ten minutes in 6 pounds/ton of ammonium bicarbonate solution and then subjected to rougher flotation with 0.04 pounds/ton of a polypropylene glycol ester available from Dow Chemical Company under the trademark "Dowfroth 250" and 1.5 pounds/ton of octadecyl butane diamine reagent. The concentrate was then cleaned and recleaned using 4 pounds/ton of ammonium bicarbonate solution. The results showed a recovery of almost 90% should be obtainable on a continuous basis.

Test No. 6

The scheelite-calcite concentrate was subjected to rougher flotation in a solution of Duomac T in distilled water. "Duomac T" is a trademark for the acetate salt of tallow-propylene diamine, which is a substituted $C_3$ diamine. Again, 0.08 pounds/ton of Aerofroth 71 was used as frother and the Duomac T was used in an amount of 0.5 pounds/ton. The concentrate was cleaned twice in water. The results showed that whilst the recovery is approximately 80% scheelite in the concentrate, the grade is poor at approximately 46%.

Test No. 7

The scheelite-calcite concentrate was subjected to rougher flotation with 0.08 pounds/ton of pine oil and 0.53 pounds/ton of mono-substituted pentane diamine reagent. The concentrate was then cleaned and recleaned using no added reagents but water. The results showed that the scheelite in the concentrate was very fine grained and the flotation of the coarser grains of scheelite was — poor, as indicated by the 12% of scheelite remaining in the rougher tailing. It was also noted that the reagent floated the very fine scheelite and calcite without any great selectivity therebetween. This appears to be an example of the $C_5$ diamine behaving like a monoamine in its poor selectivity between scheelite and calcite.

Test No. 8

The scheelite-calcite concentrate was subjected to rougher flotation using about 0.2 pounds/ton of Aerofroth 71 and 0.03 pounds per ton of pine oil. Approximately 0.53 pounds/ton of butane diamine tetradecane, $H_2N.(CH_2)_4.NH.C_{14}H_{29}$, was added to the pulp in the flotation cell. A rougher concentrate was produced on flotation, which was cleaned twice with no further additions except water.

As may be seen from Table 1, the recovery was excellent but the grade of concentrate was somewhat low. It is felt that the latter was probably due to an excess of pine oil, which produced a fairly stiff froth which tends to trap fine calcite and improves scheelite concentration.

TABLE 1

| Test No. | Product | Weight % | Est. % $CaWO_4$ | Est. Distribution % $CaWO_4$ |
|---|---|---|---|---|
| | Rougher tailing | 13.91 | 19.5 | 12.82 |
| | Cleaner tailing | 16.27 | 24.15 | 18.57 |
| 1 | Recleaner tailing | 13.65 | 25.90 | 16.71 |
| | Concentrate | 56.17 | 19.55 | 51.90 |
| | Feed | | 21.16 | |
| | Rougher tailing | 41.17 | 3.10 | 5.72 |
| | Cleaner tailing | 16.14 | 8.3 | 6.00 |
| 2 | Recleaner tailing | 17.53 | 22.45 | 17.64 |
| | Concentrate | 25.16 | 62.65 | 70.64 |
| | Feed | | 22.31 | |
| | Rougher tailing | 33.05 | 0.74 | 1.03 |
| | Cleaner tailing | 17.29 | 6.30 | 4.61 |
| 3 | Recleaner tailing | 10.51 | 19.50 | 8.67 |
| | Concentrate | 39.15 | 51.8 | 85.69 |
| | Feed | | 23.64 | |
| | Rougher tailing | 38.85 | 0.68 | 1.12 |
| | Cleaner tailing | — | — | — |
| 4 | Recleaner tailing | 11.82 | 12.50 | 6.27 |
| | Concentrate | 49.33 | 44.26 | 92.61 |
| | Feed | | 23.56 | |
| | Rougher tailing | 37.11 | 1.26 | 1.95 |
| | Cleaner tailing | 15.34 | 3.36 | 2.15 |
| 5 | Recleaner tailing | 12.65 | 13.30 | 7.04 |
| | Concentrate | 34.90 | 60.87 | 88.86 |
| | Feed | | 23.90 | |
| | Rougher tailing | 28.17 | 0.6 | 0.75 |
| | Cleaner tailing | 20.81 | 7.95 | 7.34 |
| 6 | Recleaner tailing | 12.18 | 21.25 | 11.49 |
| | Concentrate | 38.84 | 46.65 | 80.42 |
| | Feed | | 22.53 | |
| | Rougher tailing | 80.10 | 12.0 | 45.86 |
| | Cleaner tailing | 5.33 | 39.8 | 10.12 |
| 7 | Recleaner tailing | 5.33 | 60.10 | 28.70 |
| | Concentrate | 9.24 | 65.10 | 28.70 |
| | Feed | | 20.96 | 100.00 |
| | Rougher tailing | 28.64 | 2.75 | 3.49 |
| | Cleaner tailing | 13.27 | 5.54 | 3.26 |
| 8 | Recleaner tailing | 13.97 | 13.17 | 8.15 |
| | Concentrate | 44.12 | 43.55 | 85.10 |
| | Feed | 100.00 | 22.58 | 100.00 |

From the foregoing tests, it is apparent that Igepon T-33 is non-selective for scheelite over calcite; the selectivity using a monoamine is only moderate, as it is for a mono-substituted pentane diamine; the recovery using a mono-substituted propane diamine is quite good but the grade is poor. The best results are clearly obtained using a mono-substituted butane diamine, such as octadecyl butane diamine or butane diamine tetradecane.

The invention is further illustrated and exemplified with reference to the accompanying drawing, which is a schematic diagram of a plant for the treatment of scheelite - calcite concentrate in the manner of the present invention.

Referring to the drawing, the continuous lines relate to the passage of concentrate through the process, the broken dashed lines relate to the tailings and the broken dotted lines relate to the feed. The concentrate is fed into a bin 10 and thence to a feeder 11. The concentrate is then mixed with water in the mixing vessel 12 to give a slurry containing from 10 to 30% solids. The slurry is fed to a bank of rougher flotation cells 13 from which the rougher concentrate is passed through a cleaning vessel 14 and the cleaner tailings returned to the float in the cells 13. The flotation is performed in the cells 13 using an alcoholic frother (such as Aerofroth 71 or MIBC) and the flotation reagent, i.e. the mono-substituted butane diamine of the present invention. As mentioned above, the tailings from the cleaning vessel 14 are recycled through the rougher flotation cells 13 and the cleaner concentrate is recleaned by passage through a recleaning vessel 15. Recleaner tailings are recycled to cleaner 14. Cleaning and recleaning are performed with water, no other cleaning agents normally being required, although an alkali such as ammonium bicarbonate, may be used, if desired. The final scheelite concentrate is then passed to filtration and drying.

The rougher tailings from the rougher flotation cells 13 may be passed to a table 16 for recovery of coarser unfloated particles of scheelite, if required.

I claim:

1. A process for the separation of scheelite from calcite present in an ore or a concentrate formed from an ore, the process comprising the steps of:

a. decomposing any flotation agent residues contained in said concentrate;

b. treating said ore or concentrate to condition the particle surfaces with a mono-substituted butane diamine of the formula $H_2N.C_4H_8.N(H)R$, wherein R is a long-chain saturated or partially-unsaturated aliphatic hydrocarbon radical having at least 14 carbon atoms;

c. subjecting the treated ore or concentrate to flotation in an aqueous system; and d. recovering the scheelite in the flotation froth.

2. The process of claim 1, wherein R contains from 14 to 18 carbon atoms, inclusive.

3. The process of claim 2, wherein said mono-substituted butane diamine is added in a concentration of from about 0.1 to about 2.0 pounds per ton of ore or concentrate.

4. The process of claim 1, wherein R is a naturally occurring mixture of aliphatic $C_{16}$–$C_{18}$ radicals.

5. The process of claim 1, wherein said mono-substituted butane diamine is added in a concentration of from about 0.1 to about 2.0 pounds per ton of ore or concentrate.

6. The process of claim 1, wherein any flotation agent residues contained in said concentrate are decomposed by heating.

7. The process of claim 1, wherein said concentrate is formed by fatty acid flotation from an ore and any fatty acid residues contained in said concentrate are decomposed by heating.

8. A process for the separation of scheelite from calcite present in an ore or a concentrate formed from an ore, the process comprising the steps of:

a. decomposing any flotation agent residues contained in said concentrate;

b. feeding said ore or concentrate to a mixing vessel and admixing therein said ore or concentrate with water to form a slurry containing from 10 to 30% solids;

c. feeding said slurry to a bank of rougher flotation cells containing an alcoholic frother and a flotation agent comprising a mono-substituted butane diamine of the formula $H_2N.C_4H_8.N(H)R$, wherein R is a long-chain saturated or partially-unsaturated aliphatic hydrocarbon radical having at least 14 carbon atoms, to provide a rougher concentrate;

d. passing said rougher concentrate through a cleaning vessel containing an aqueous cleaning medium to provide cleaner tailings and a cleaner concentrate;

e. recycling said cleaner tailings through said rougher flotation cells to said cleaning vessel;

f. passing said cleaner concentrate from said cleaning vessel to a recleaning vessel containing an aqueous cleaning medium to provide recleaner tailings and a final scheelite concentrate in the flotation froth; and g. recycling said recleaner tailings through said cleaning vessel to said recleaning vessel and filtering and drying said final scheelite concentrate.

9. The process of claim 8, wherein said aqueous medium is water.

10. The process of claim 8, wherein said aqueous medium is an alkaline solution.

11. The process of claim 10, wherein said alkaline solution is sodium bicarbonate.

12. The process of claim 8, wherein R contains from 14 to 18 carbon atoms, inclusive.

13. The process of claim 8, wherein R is a naturally occurring mixture of aliphatic $C_{16}$–$C_{18}$ radicals.

14. The process of claim 8, wherein said mono-substituted butane diamine is added in a concentration of from about 0.1 to about 2 pounds per ton of ore or concentrate.

* * * * *